US009669852B2

(12) United States Patent
Combs

(10) Patent No.: US 9,669,852 B2
(45) Date of Patent: Jun. 6, 2017

(54) WASHOUT DETECTOR AND ALARM APPARATUSES AND METHODS THEREOF

(71) Applicant: Mark E. Combs, Morrisville, NY (US)

(72) Inventor: Mark E. Combs, Morrisville, NY (US)

( * ) Notice: Subject to any disclaimer, the term of this patent is extended or adjusted under 35 U.S.C. 154(b) by 291 days.

(21) Appl. No.: 14/467,765

(22) Filed: Aug. 25, 2014

(65) Prior Publication Data

US 2016/0052532 A1 Feb. 25, 2016

(51) Int. Cl.
*B61L 23/00* (2006.01)
*B61L 23/04* (2006.01)

(52) U.S. Cl.
CPC ..... *B61L 23/048* (2013.01)

(58) Field of Classification Search
CPC .... B61L 23/042; B61L 23/044; B61L 23/045; B61L 23/047; B61L 23/048
See application file for complete search history.

(56) References Cited

U.S. PATENT DOCUMENTS 3,857,582 A * 12/1974 Hartog ..... B60S 9/02 248/354.1
4,865,295 A * 9/1989 Holloway ..... B60S 9/12 254/423
6,205,946 B1 * 3/2001 Picton ..... E01B 35/00 116/215
2003/0146207 A1 * 8/2003 Reichle ..... H05B 6/105 219/635
2009/0070064 A1 * 3/2009 Farritor ..... B61K 9/08 702/150
2012/0192756 A1 * 8/2012 Miller ..... B61K 9/08 104/2
2012/0257195 A1 * 10/2012 Scherf ..... B61K 9/08 356/237.1
2013/0070083 A1 * 3/2013 Snead ..... G01L 1/24 348/125
2014/0116850 A1 * 5/2014 Musick ..... B65G 17/086 198/617
2015/0291192 A1 * 10/2015 Li ..... B61K 9/10 246/121
2016/0052532 A1 * 2/2016 Combs ..... B61L 23/048 246/121

OTHER PUBLICATIONS

International Search Report for International Patent Application No. PCT/US15/46663, mailed Nov. 30, 2015.

* cited by examiner

*Primary Examiner* — Jason C Smith
(74) *Attorney, Agent, or Firm* — LeClairRyan, a Professional Corporation

(57) ABSTRACT

A washout detector apparatus includes a detector member movably disposed in at least a portion of a detector housing, the detector housing is configured to be secured to a structure. A biasing device is disposed in and positioned to bias the detector member in a direction out from the portion of the detector housing towards a surface perpendicular to the structure. An indicator is coupled to the detector member to provide a condition of the surface based on movement of the detector member with respect to the surface. A method for making a washout detector apparatus is also disclosed.

20 Claims, 14 Drawing Sheets

WASHOUT DETECTOR AND ALARM APPARATUSES AND METHODS THEREOF

FIELD

This technology generally relates to washout detector devices and methods and, more particularly, to washout detector and alarm apparatuses and methods thereof.

BACKGROUND

Structures such as homes, bridges, and railroad ties may be negatively affected by the erosion of the ground underneath. In particular, washouts, in which the ground beneath a railroad tie or a bridge is eroded away by flowing water, present a dangerous situation. Prior warnings regarding potential washout conditions are imperative to ensure safety. Washout detectors serve to provide advance warning regarding the conditions. However, such washout detectors need to be cost effective so that a sufficient number of detectors may be acquired and located at various locations, for example along railroad tracks or at the bases of bridges, to detect washout conditions. Cost effective washout detectors are also more practical for home usage. Further, washout detectors applied for such situations, particularly to railroad ties and bridges, must be sturdy enough to withstand both the forces created by, for example, trains passing over the tracks as well the elements to which the washout detectors are subjected.

DETAILED DESCRIPTION

Figure 1:
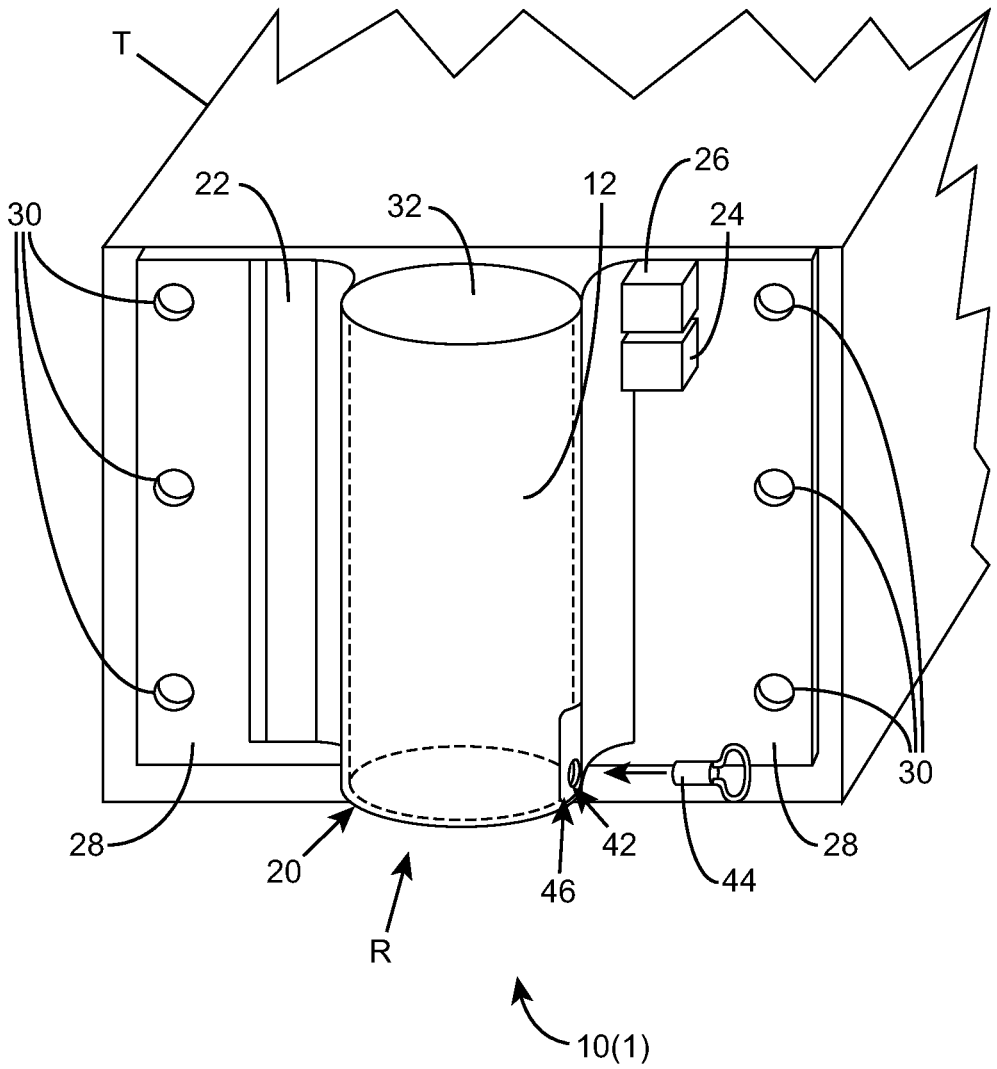
FIG. 1 is a perspective view of an exemplary washout detector apparatus coupled to the end of a railroad tie.

An example of a washout detector 10(1) is illustrated in FIGS. 1-4. The washout detector 10(1) includes a housing 12, a spring 14, a spring-loaded ram 16, an optional hydraulic ram 18 and hydraulic reservoir 19, a pad 20, an indicator device 22, and an optional sensor 24 and remote alarm computing device 26, although the washout detector 10(1) may have other types and/or numbers of systems, device, components and/or other elements in other configurations.

The exemplary washout detector 10(1) is configured to be coupled to a railroad tie T to determine the status of the ballast B located below the washout detector 10(1) and to detect and provide notification of washout conditions both locally and remotely. One or more detectors 10(1) may be utilized with a single railroad tie T to indicate the condition of the roadbed in various locations about the railroad tie T. Although the washout detector 10(1) is illustrated and described with respect to use on a railroad tie T, it is to be understood that the washout detector 10(1) may be applied to any structure with a surface perpendicular to the structure for which washout conditions may be monitored. By way of example only, the washout detector 10(1) of the present technology may be utilized to monitor washout conditions on support structures (footers) of bridges or at the base of a building to monitor the condition of the ground perpendicular to those structures. The size and of the washout detector 10(1) may be varied based on these different applications.

In this example, the washout detector 10(1) reports washout conditions in three different stages, as described further below, to provide information regarding the condition of the ballast on the roadbed. The exemplary technology provides notification of a potential washout in various stages, from incipient to terminal washout conditions. This exemplary technology advantageously provides a washout detector that may be easily installed on the railroad tie T and provides a visual indication of the condition of the roadbed.

Referring more specifically to FIG. 1, in this example the housing 12 is configured to be coupled to the railroad tie T to connect the washout detector 10(1) to the railroad T tie through flanges 28 located on both sides of the housing 12, although the housing 12 may have other configurations for attachment to the railroad tie T. In one example, the housing 12 provides a small sturdy housing which protects the inner pieces of the detector 10(1) from the elements. The flanges 28 include holes 30 configured to receive lag bolts to secure the housing 12 to the railroad tie T, although the washout detector 10(1) may include other elements in other locations for securing the washout detector 10(1) to the railroad tie T. In one example, the housing 12 includes a detachable back panel (not shown) that permits access to the elements within the housing 12. The housing 12 is coupled to the railroad tie T at the end of the railroad tie T, although the housing may be coupled to the railroad tie T at other locations, such as along the side of the railroad tie T.

Figure 2:
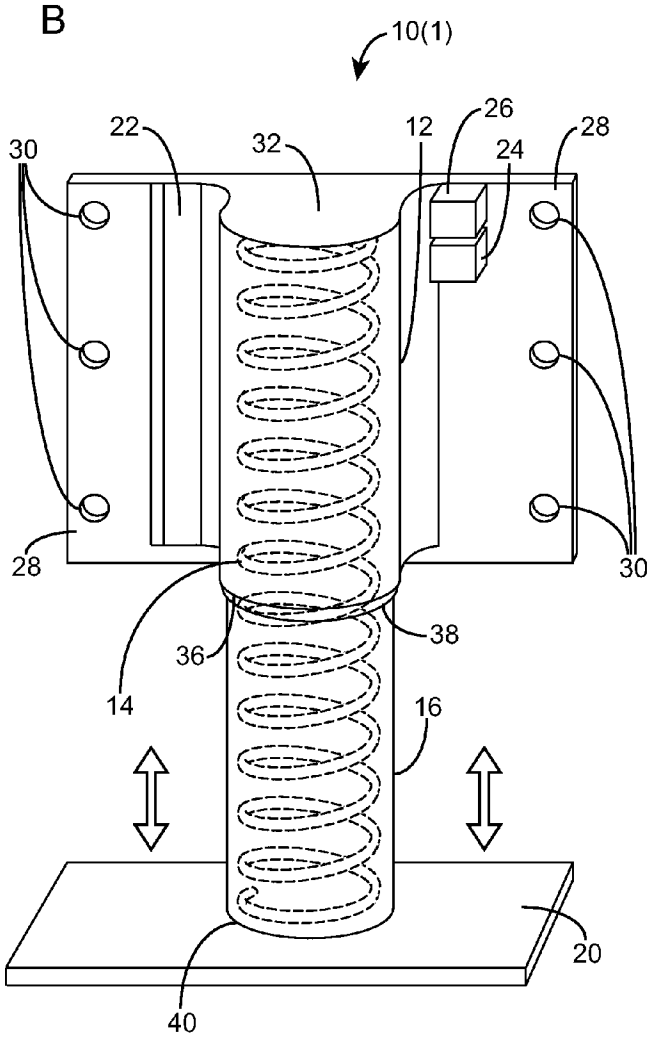
FIG. 2 is a perspective partial phantom and partial exploded view of the exemplary washout detector as shown in FIG. 1 with the spring-loaded ram extended from the housing.
Figure 2:
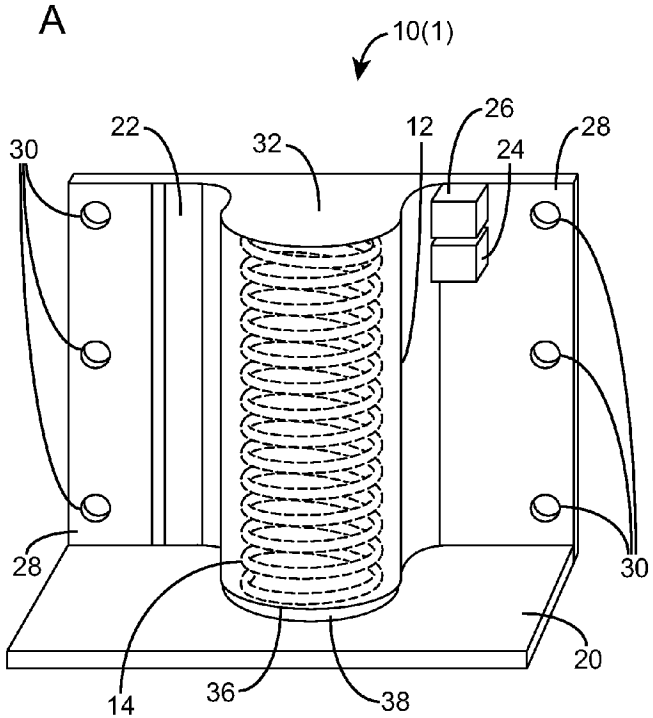
Figure 2:
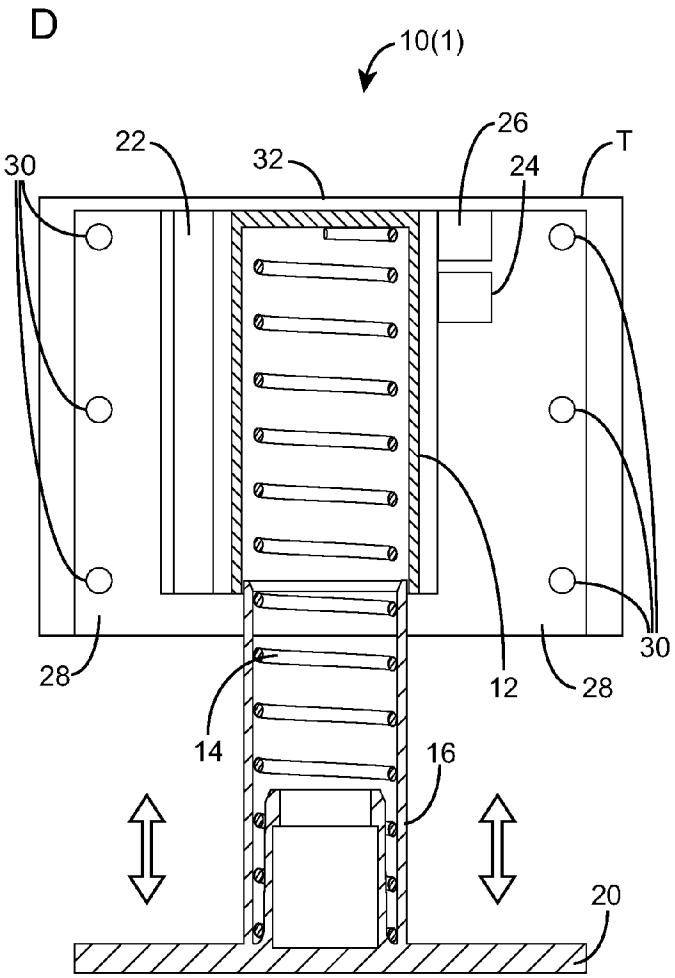
Figure 2:
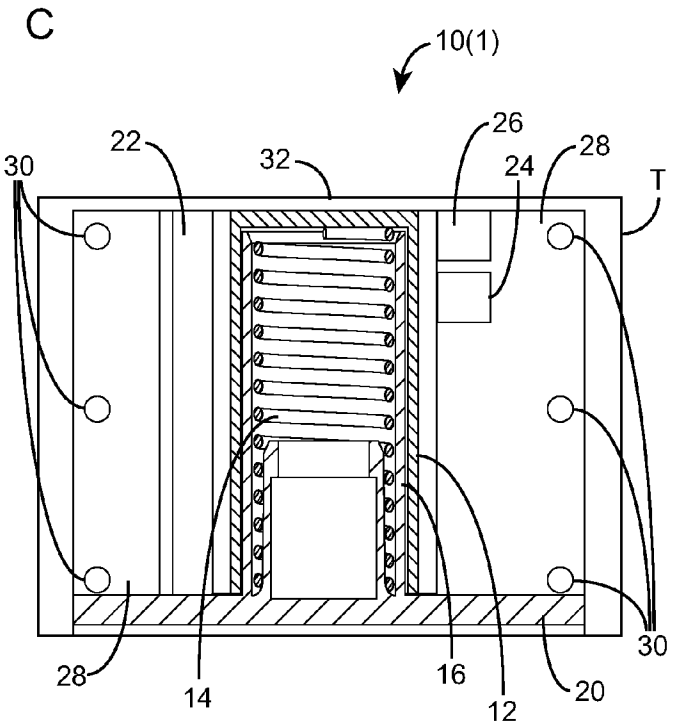
Figure 4:
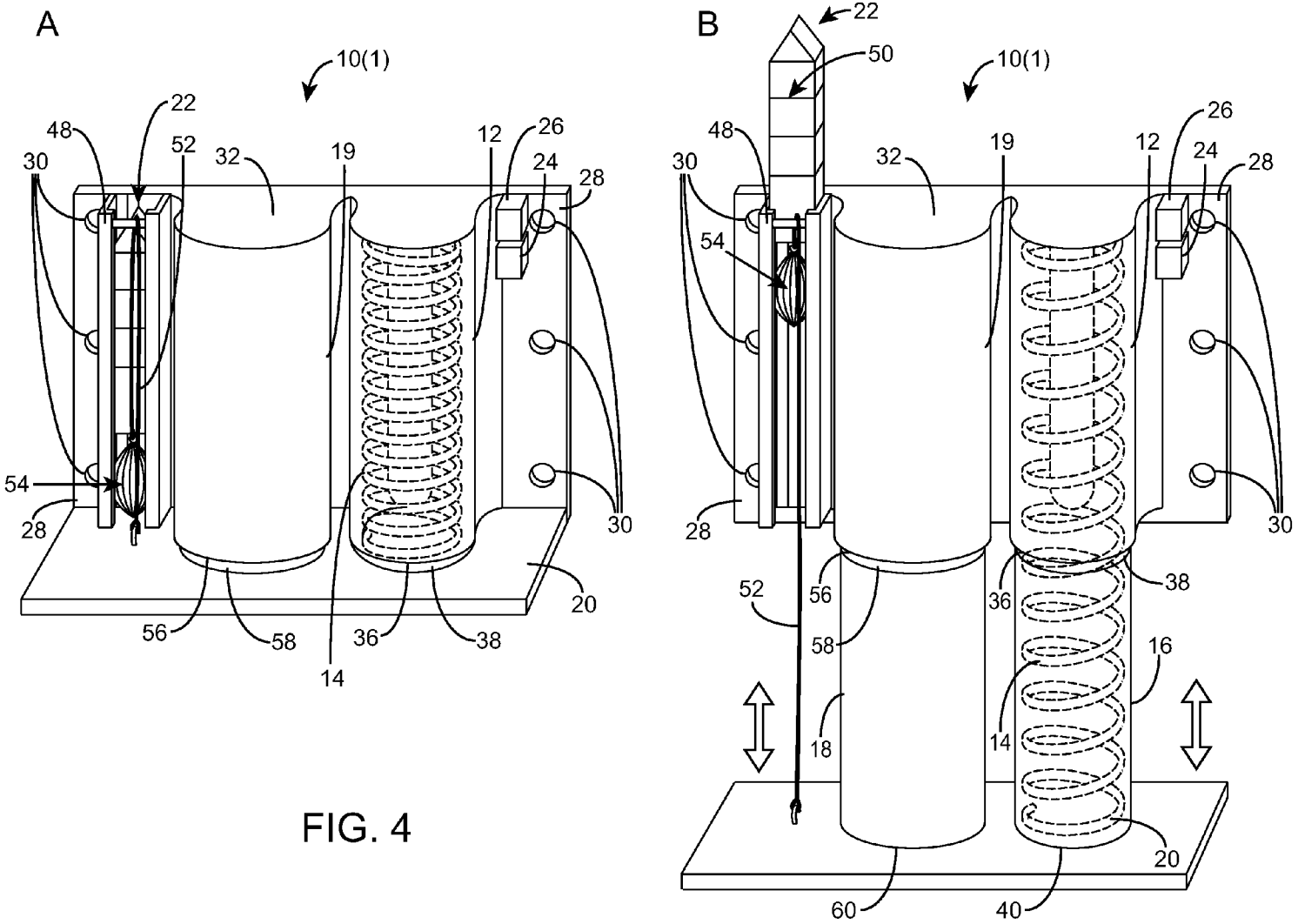
FIG. 4 is a perspective partial phantom view of an exemplary washout detector with an optional hydraulic ram with the spring-loaded ram and hydraulic ram extended from the housing.
Figure 4:
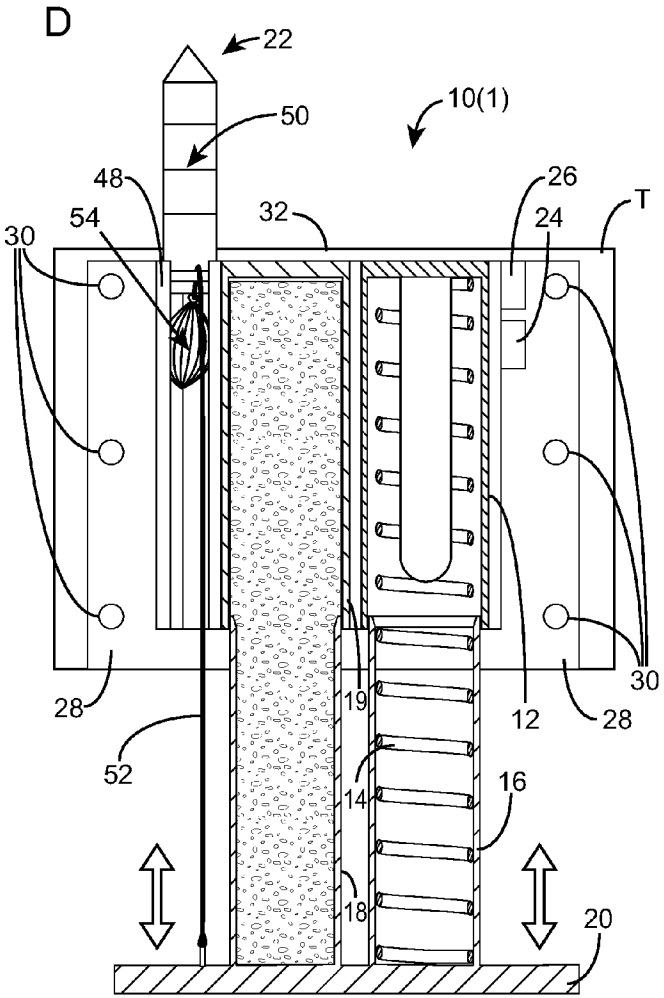
Figure 4:
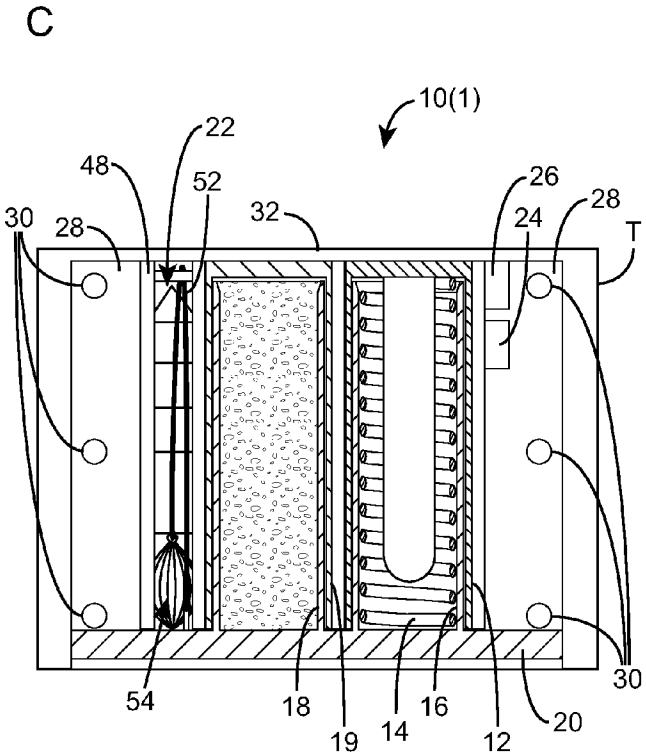

The housing 12 includes a main body portion 32 configured to house the spring 14 and the spring-loaded ram 16 as shown in FIG. 2, although the housing 12 may be configured to house other elements in other configurations, such as, by way of example, the optional hydraulic ram 18 and hydraulic reservoir as shown in FIG. 4. Referring more specifically to FIG. 2, the spring 14 is located between the top portion of the housing 12 and the spring-loaded ram 16. In this example, the spring 14 is casted into the housing 12 and the ram 16, although the spring 14 may be connected to the housing 12 and the ram 16 in other manners. The housing 12 may further include a stabilizing bar 34 located within the coils of the spring 14 in order to keep the spring 14 straight when being pushed in the housing 12.

The ram 16 is constructed of a material, such as metal, with sufficient strength to withstand the force of the spring 14, although the ram 16 may be constructed of other materials. The ram 16 is connected to the pad 20 at the end opposite the spring 14, such that the spring-loaded ram 16 exerts a downward force on the pad 20. The housing 12 includes an opening 36 at the bottom portion through which the ram 16 exits the housing 12. A weather seal 38 is located around the opening 36 to prevent moisture or dirt from entering the housing 12.

The pad 20 is a large flat metal plate configured to sit on the ballast of the roadbed and distribute the downward force of the spring-loaded ram 16, although the pad 20 may have other configurations and be constructed of other materials. The pad 20 includes a collar 40 for receiving the ram 16 such that the ram 16 sets into the collar 40. In one example, the connection between the ram 16 and the collar 40 may be on a pivot system such that the pad 20 can angle to the contour of the ballast due to erosion and shifting of the ballast which may present washout conditions, although other connections between the ram 16 and the pad 20, such as welding, may be utilized.

Referring back to FIG. 1, the housing 12 further includes a locking mechanism used to lock the housing 12 to the pad 20 when the washout detector 20 is not in use or prior to installation of the washout detector 10(1) on the railroad tie T. By way of example, the locking mechanism may be a tab 42 configured to receive a cotter pin 44, although other locking mechanisms may be utilized. The pad 20 also includes a locking mechanism, such as a tab 46 configured to align with the tab 42 on the housing to receive the cotter pin 44 to secure the pad 20 to the housing 12 while the washout detector is not in use or prior to installation, although other locking mechanisms may be utilized.

Figure 3:
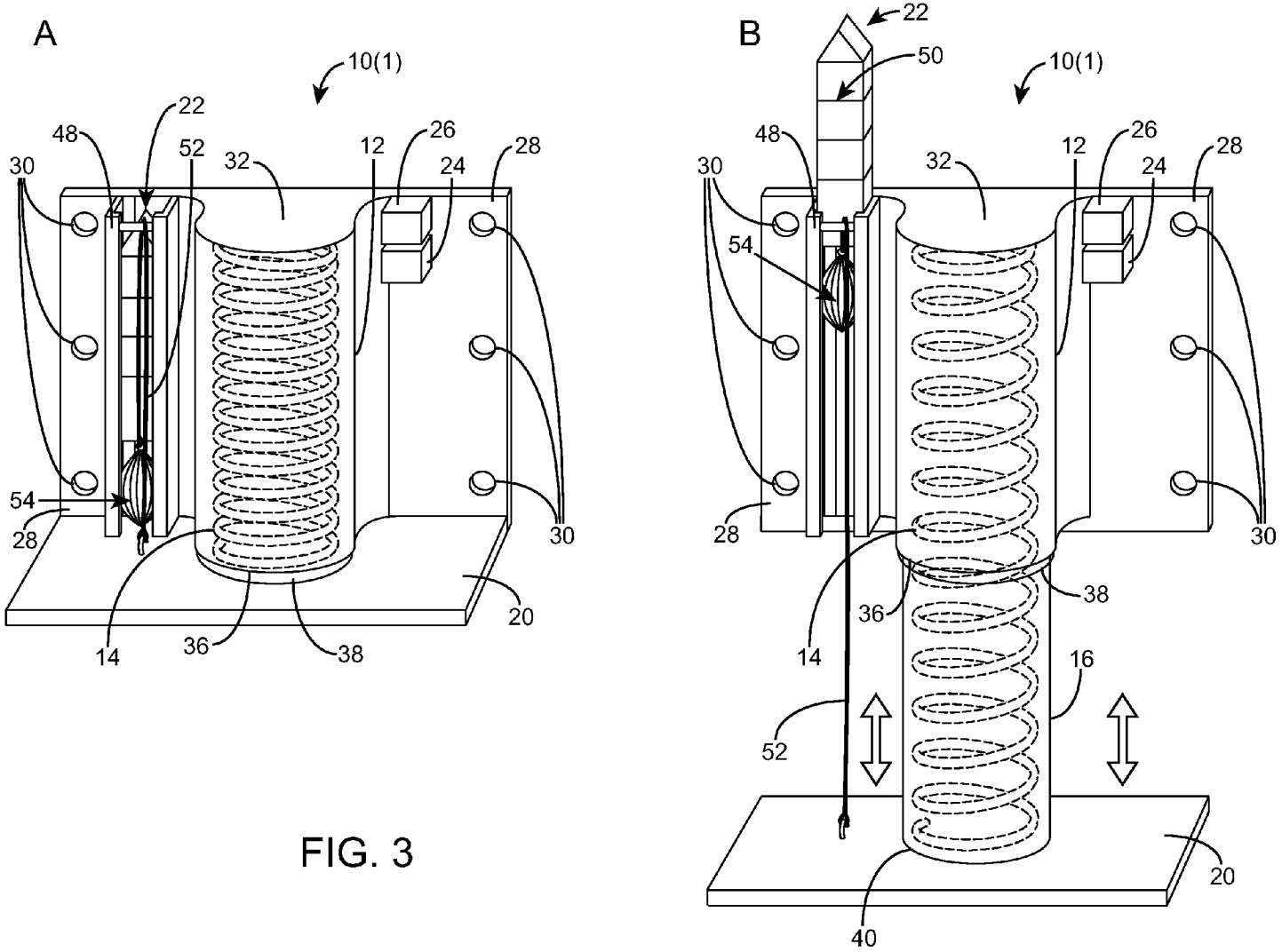
FIG. 3 is a perspective view of spring-loaded ram and indicator housing with indicator blade of the exemplary washout detector without the outer housing.
Figure 3:
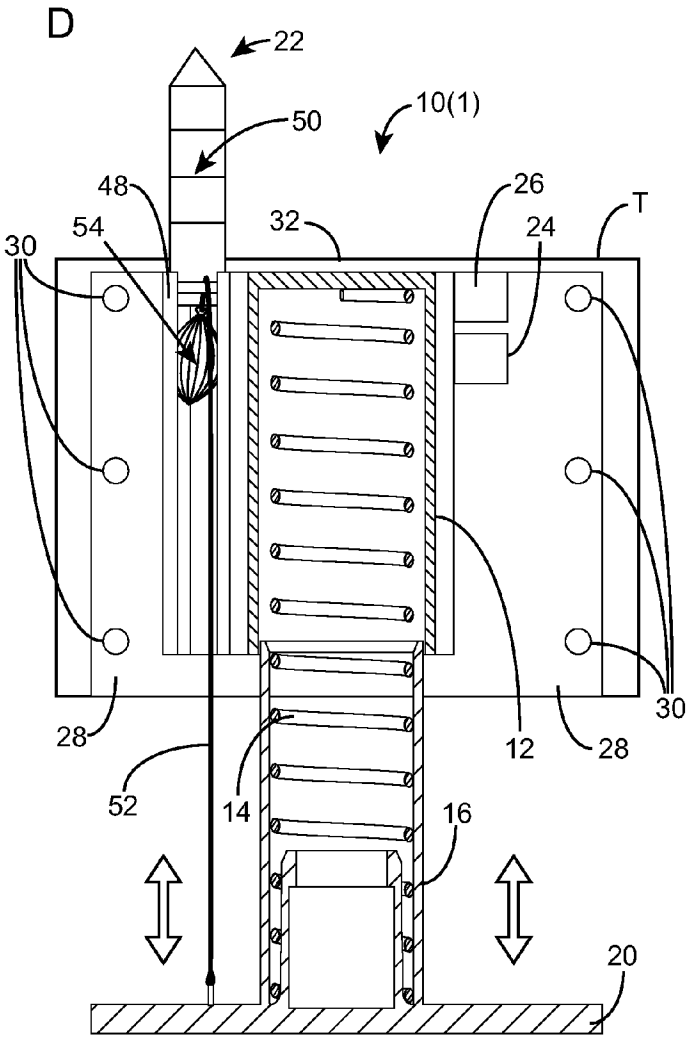
Figure 3:
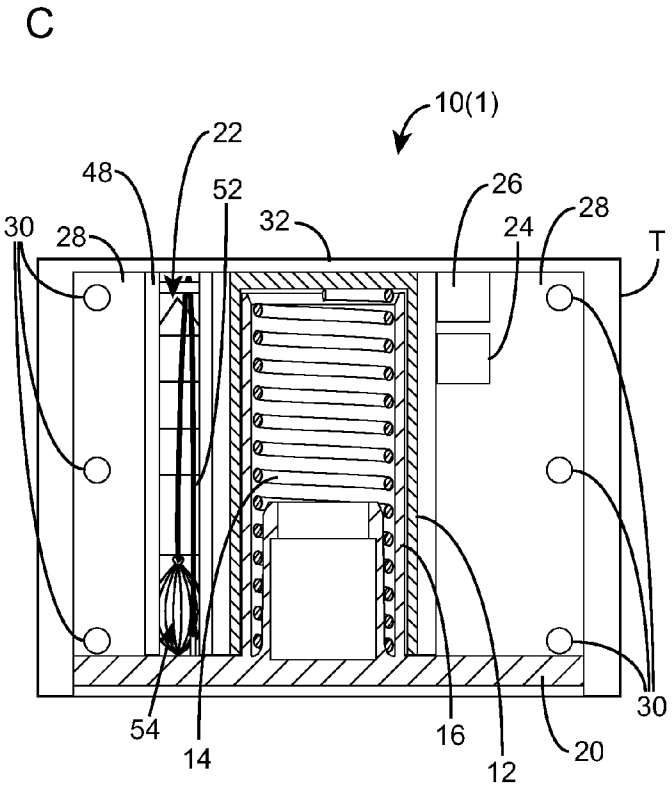

The washout detector 10(1) further includes an indicator device 22 coupled to the housing 12. Referring now to FIG. 3, the indicator device 22 includes an indicator housing 48, an indicator blade 50, and a pulley system 52. The indicator housing 48 is configured to house the indicator blade 50 and includes an opening through the top of the indicator housing 48 through which the indicator blade 50 may emerge. The indicator blade 50 is coupled to the pad 20 through a wire to form the pulley system 52 such that downward motion of the pad 20 causes the indicator blade 50 to rise out of the indicator housing 48, although the indicator blade 50 may be coupled to the pad 20 through other elements in other configurations.

In one embodiment, the indicator blade 50 includes three different sections along its length having different colors, although the indicator blade may have other numbers and types of sections. The individual sections may be divided equally along the length of the indicator blade 50, although the sections may each have different lengths along the indicator blade 50. The different sections are configured to provide a visual indication of the roadbed condition. The indicator blade 50 may further include an end of travel indicator 54, as shown in FIG. 4, which pops out at the full extent of travel of the indicator blade 50 within the indicator housing 48. The end of travel indicator 54 can be in the form of a tough flexible football shaped pouch containing an expanded wire spiral form shaped to a similar size, which is compressed and collapsed into the indicator housing 48 and is then decompressed when the end of travel indicator 54 is released from the indicator housing 48, although the end of travel indicator 54 could have other configurations. By way of example, the end of travel indicator 54 may be a cube corner reflector.

In another example, as shown in FIG. 4, the housing 12 may further include the optional hydraulic ram 18. In this example, the housing 12 includes an opening 56 in the bottom potion of the housing that allows the hydraulic ram 18 to exit the housing 12. The opening 56 may include a weather seal 58 to prevent water or dirt from entering the housing 12 through the opening. The hydraulic ram 18 is coupled to the pad 20 through a collar 60 in the pad 20. By way of example, the hydraulic ram 18 may be welded to the pad 20. The hydraulic ram 18 is coupled to a hydraulic fluid reservoir 19 through one or more poppet valves 62, although the hydraulic ram 18 may be coupled to the hydraulic fluid reservoir 19 in other manners using other types of valves. The hydraulic fluid reservoir 19 is configured to hold hydraulic fluid which may be drawn into the area of the housing vacated by the hydraulic ram 18 through the poppet valves 62 as the pad 20 descends pulling the hydraulic ram 18 in a downward direction.

Referring back to FIG. 1, the washout detector 10(1) may also include a remote alarm computing device 26 coupled to a sensor 24 to provide remote alerts regarding the condition of the roadbed. The sensor 24 is configured to measure the movement of the pad 20 with respect to the ballast underneath. The sensor 24 may be a manual sensor, such as a rod-and-foot linear drop sensor, or an angled-paddle rotary-horizontal-shaft sensor, although other types and/or numbers of sensors could be used. These units are spring-powered for both the pressing downward of the sensing rod and foot. Alternatively, the sensor 24 may measure the movement of the pad 20 through non-contact mechanisms, such as by way of example, through ultrasonic distance detection, electro-magnetic or electro-optical distance or auto-focus sensing methods, although other remote-sensing methods may be utilized. The sensor 24 is coupled to the remote alarm computing device 26 to provide information regarding the position of the pad 20 and provide alerts regarding potential washout conditions. In another embodiment, the sensor 24 may be a self-leveler that detects if the tie T is going unlevel. The sensor 24 may provide information to the remote alarm computing device 26 to indicate that the level of the tie T is going off plane.

The remote alarm computing device 26 may provide remote alerts regarding the position of the pad 20 and potential washout conditions to one or more computing devices through a communication network. The alarm computing device 26 may include at least one processor, a memory, an input device, a display device, and an input/output (I/O) system, which are coupled together by a bus, although the alarm computing device 26 may comprise other types and numbers of systems, device, components and/or other elements in other configurations and other types of alarm computing devices could be used.

The processor(s) in the remote alarm computing device 26 may execute one or more computer-executable instructions stored in the memory to provide remote alerts regarding the condition of the roadbed, although the processor(s) can execute other types and numbers of instructions and perform other types and numbers of operations. The processor(s) may comprise one or more central processing units ("CPUs") or general purpose processors with one or more processing cores, such as AMD® processor(s), although other types of processor(s) could be used (e.g., Intel®).

The memory may comprise one or more tangible storage media, such as RAM, ROM, flash memory, CD-ROM, floppy disk, hard disk drive(s), solid state memory, DVD, or any other memory storage types or devices, including combinations thereof, which are known to those of ordinary skill in the art. The memory may store one or more programmed instructions of this technology that may be executed by the one or more processor(s), such as by way of example, providing remote alerts based on the roadbed condition information received from the sensor 26, although other types and numbers of programmed instructions and/or other data may be stored. The memory may also store data from the sensor 26, although the data could be stored in other locations on other devices.

The input device of the remote alarm computing device 26 enables a user, such as an administrator, to interact with the remote alarm computing device 26, such as to input and/or view data and/or to configure, program and/or operate it by way of example only. By way of example only, the input device may include one or more of a touch screen, keyboard and/or a computer mouse.

The display device of the remote alarm computing device 26 enables a user, such as an administrator, to interact with remote alarm computing device, such as to view and/or input information and/or to configure, program and/or operate it by way of example only. By way of example only, the display device may include one or more of a CRT, LED monitor, LCD monitor, or touch screen display technology although other types and numbers of display devices could be used.

The I/O system in the remote alarm computing device 26 is used to operatively couple and communicate between alarm computing device and one or more computing devices, which are coupled together by a communication network. The I/O system engages in network communications over a communication network utilizing standard network protocols such as TCP/IP, HTTP, or DNS, by way of example only. In this example, the bus is a hyper-transport bus, although other bus types and links may be used, such as PCI.

Figure 5:
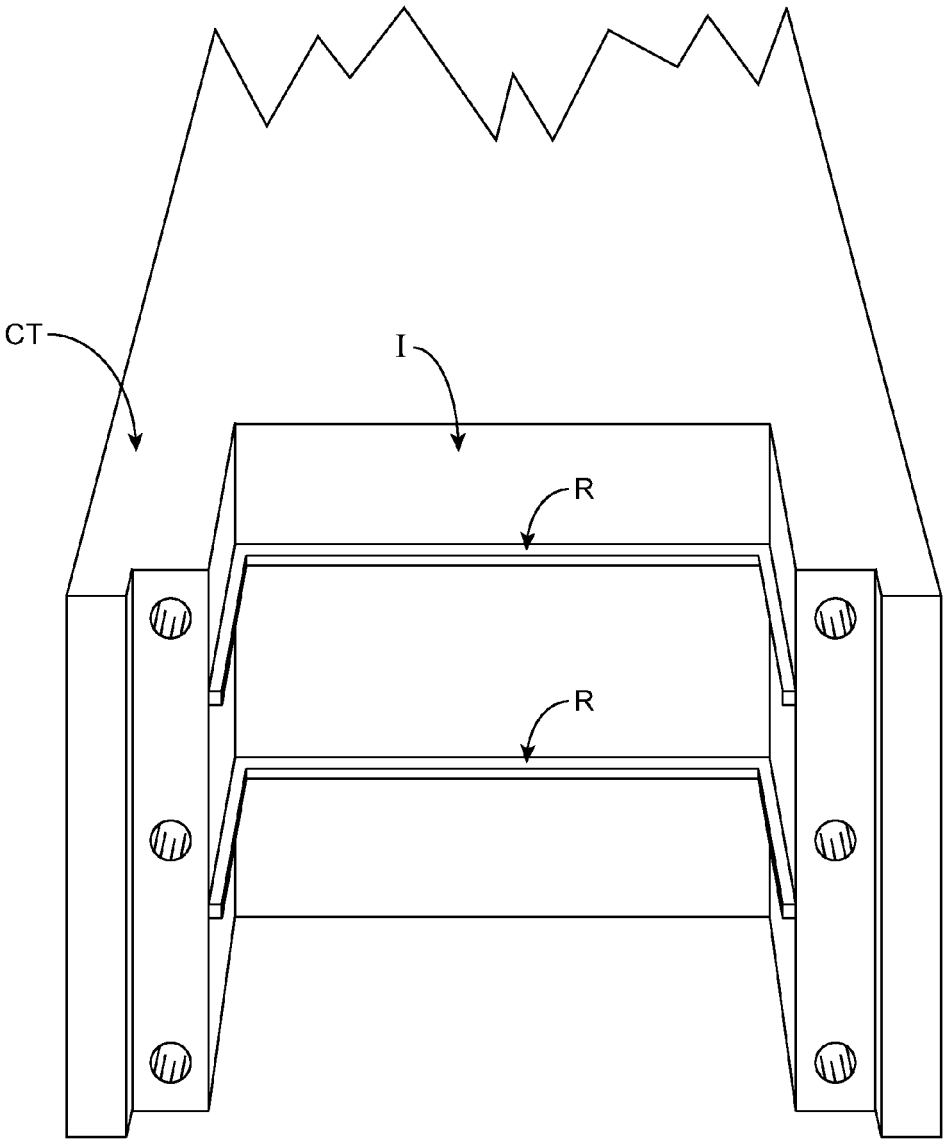
FIG. 5 is a perspective view of a composite railroad tie for use with one embodiment of the exemplary railroad roadbed washout detector.
Figure 6:
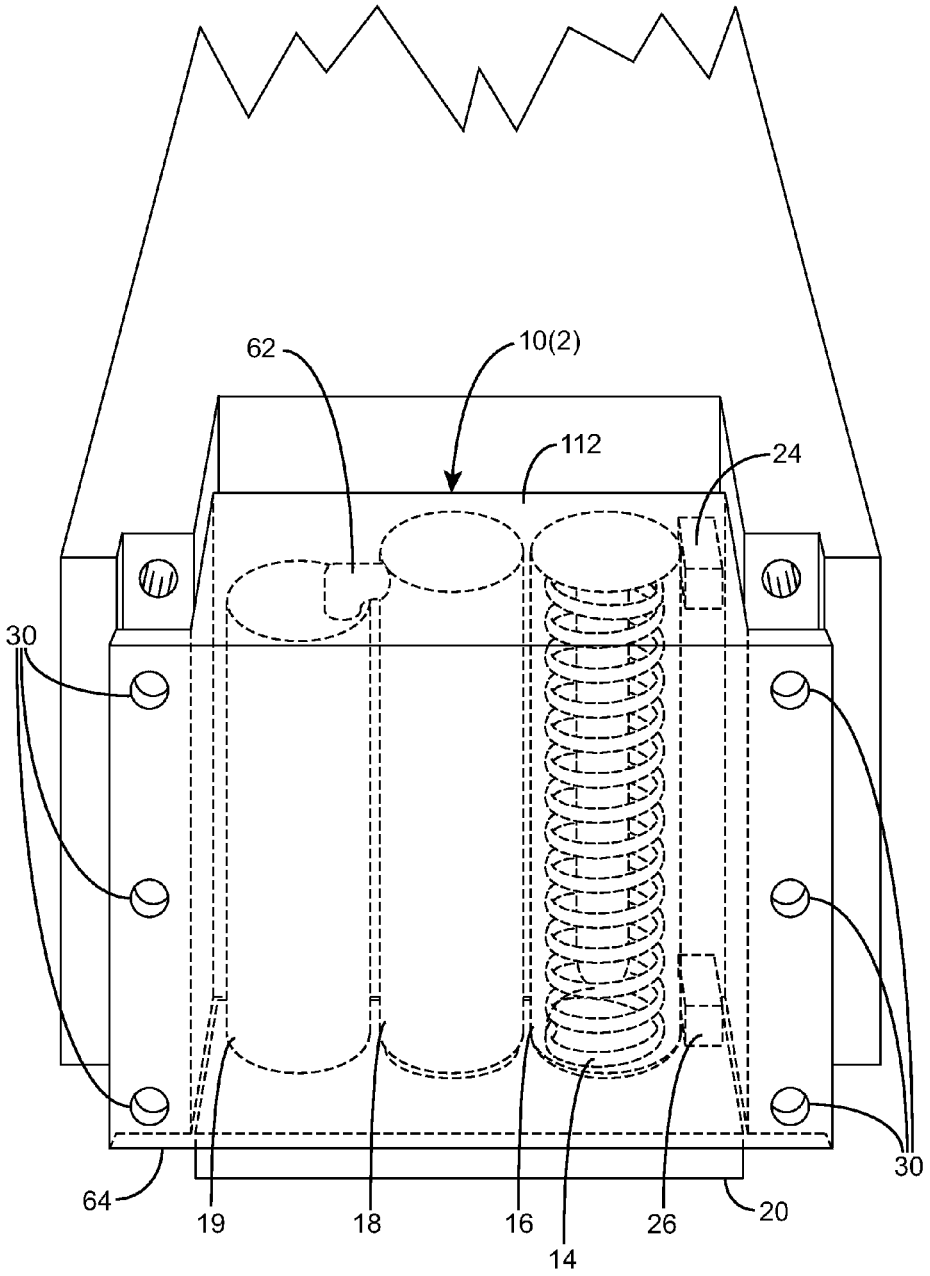
FIG. 6 is a perspective view of an exemplary railroad roadbed washout detector installed in the composite railroad tie shown in FIG. 5 with the black plate removed.
Figure 7:
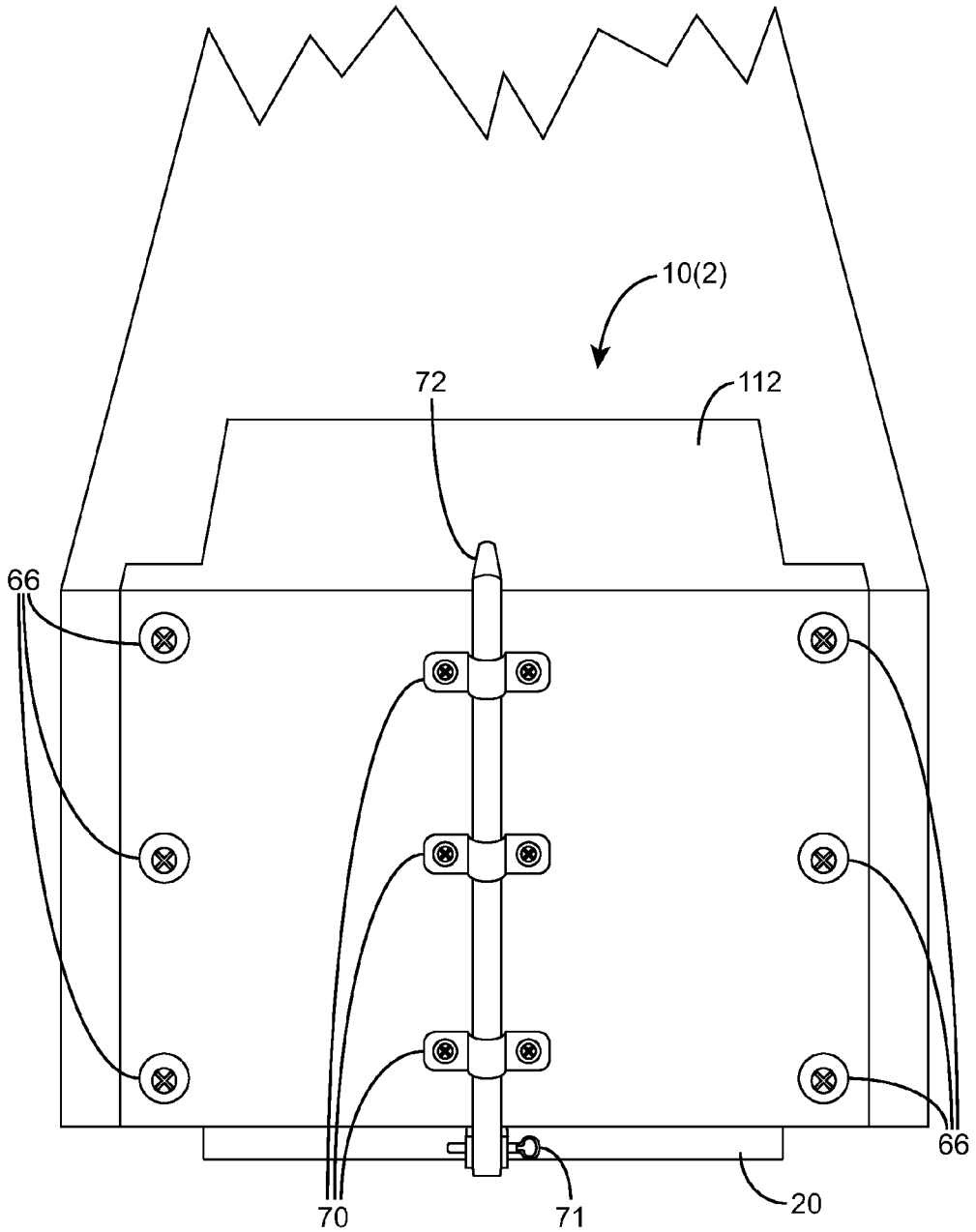
FIG. 7 is a perspective view of the exemplary railroad roadbed washout detector shown in FIG. 6 with the black plate installed.
Figure 8:
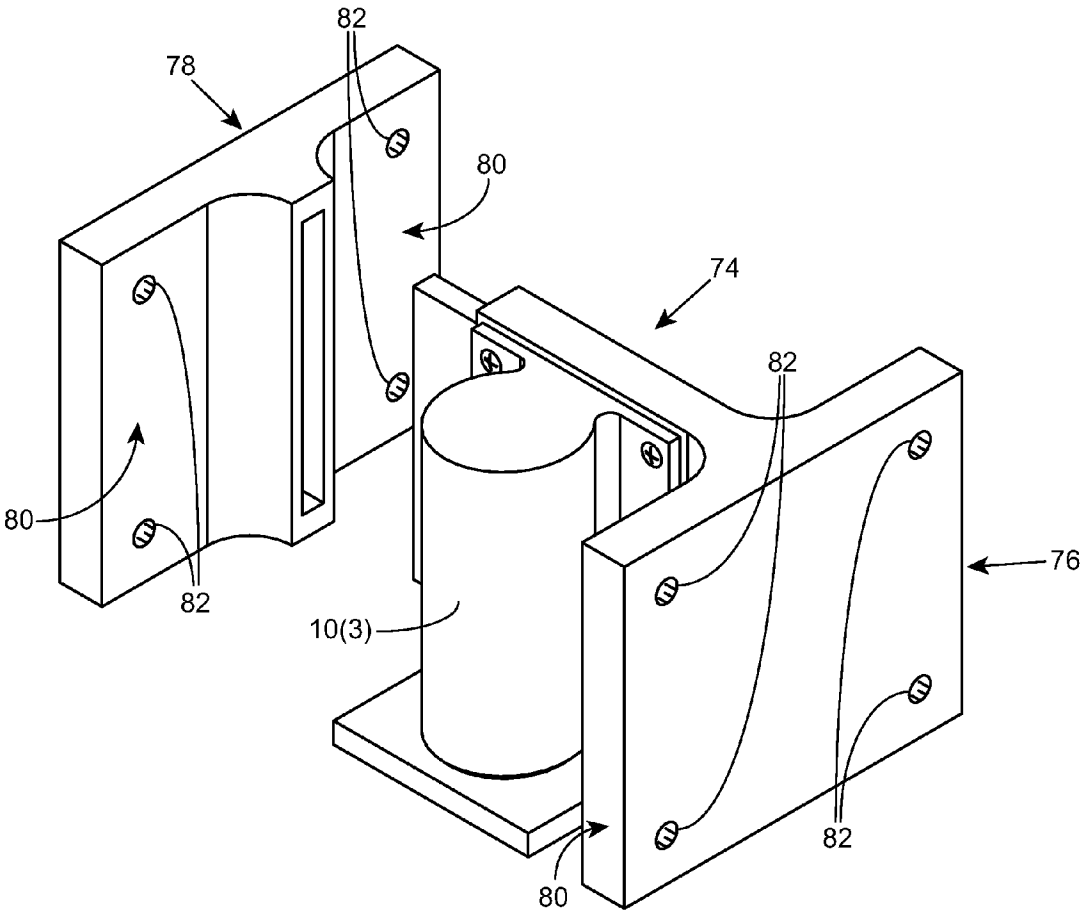
FIGS. 8-11 are perspective views of an exemplary railroad roadbed washout detector.

Another embodiment of a washout detector 10(2) is shown in FIGS. 5-7. The washout detector 10(2) is the same in structure and operation as the washout detector 10(1) shown in FIGS. 1-4 except as illustrated and described herein. In this embodiment, the housing 112 is configured to be located inside a composite tie CT as shown in FIG. 5.

As shown in FIG. 5, the composite tie CT includes an indentation I at the end of the tie configured to receive the housing, although the composite tie CT may have other features at other locations of the composite tie CT, such as by way of example along the side of the tie, for receiving the housing 112. The composite tie CT further includes a number of ribs R on the inside surface in order to mate with the housing 112 for a more secure attachment.

Referring now to FIG. 6, the housing 112 is configured to be inserted inside the end of the composite tie CT, although the housing 112 may be located in other locations such as under the railroad tie, or under a tie plate (not shown). In this example, the housing 112 includes a plate 64 that encloses the washout detector 10(2) within the composite tie CT. The plate 64 includes a number of holes 66 configured to match up with the holes 30 in the flanges 28 of the housing 112 to secure the housing 112 to the composite railroad tie CT, although other securing mechanisms may be utilized. The plate 64 may completely enclose the washout detector as shown in FIG. 7.

Referring now to FIG. 7, the plate 66 may further include a locking bar 68 secured to the plate 66 by one or more tabs 70. The locking bar 68 may pivot within the tabs 70. The locking bar 68 is connected at one end to the pad 20 through a fastener 71, although the locking bar 68 may be coupled to the pad 20 in other manners. The locking bar 68 also includes a tab 72 at the other end that extends over the top cover of the plate 66 when in a locked position. The locking bar 66 is the length of the tie such that when the tab 72 is extended over the top cover of the plate 66 the pad 20 is held in place with the spring fully compressed within the housing 112.

Another embodiment of a washout detector 10(3) is shown in FIG. 8-11. The washout detector 10(3) is the same in structure and operation as the washout detector 10(1) shown in FIGS. 1-4 except as illustrated and described herein. In this embodiment, the washout detector is configured to be coupled to a railroad tie as described in U.S. patent application Ser. Nos. 13/841,958 and 14/222,355, which are each herein incorporated by reference in their entirety.

Figure 9:
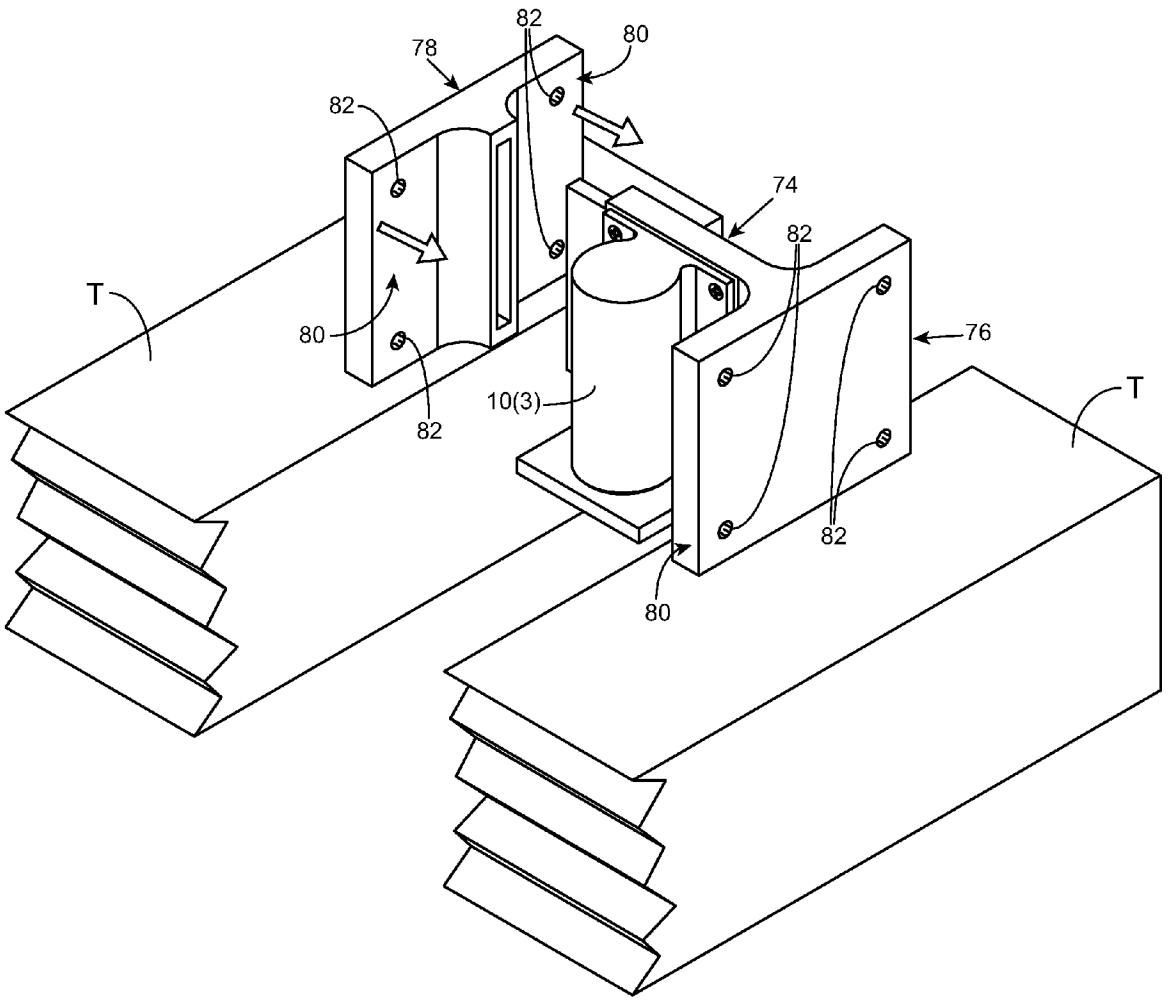
Figure 10:
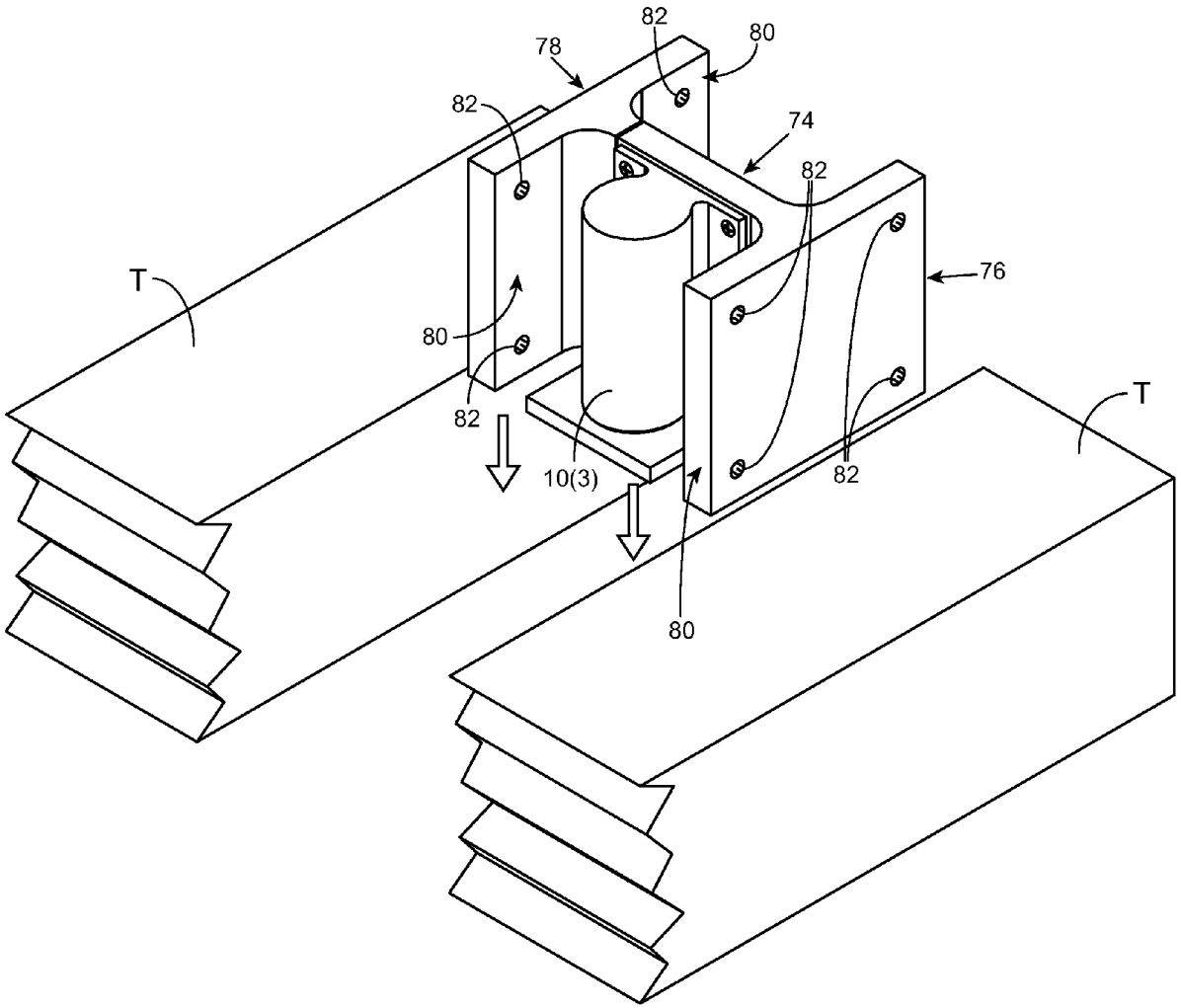
Figure 11:
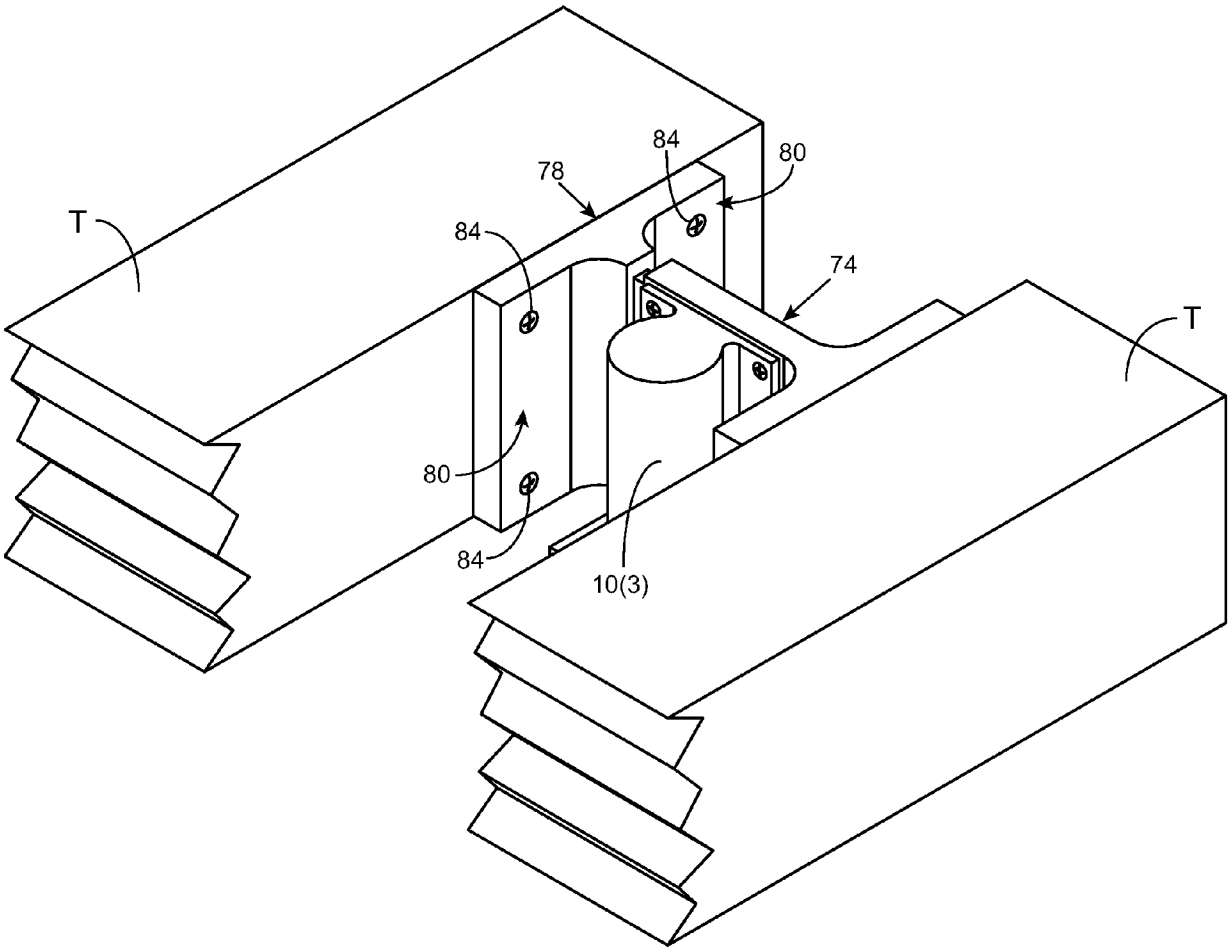

Referring to FIG. 8-11, in this embodiment, a shield plate 74 is inserted between the ties that hold the washout device 10(3). In one embodiment, the shield plate 74 includes a male portion 76 and a female portion 78, although the shield plate 74 may include other elements in other configurations. As illustrated in FIG. 9, the male portion 76 is inserted into the female portion to fit within the armature of the railroad ties. As illustrated in FIGS. 10 and 11, the shield plate 74 pushes up against the armature of the railroad ties to stabilize the shield plate 74. The shield plate 74 also serves as a blocker for the stone from the ballast of the railroad bed. The washout device 10(3) can be mounted to the middle or the side of the shield plate 74. Flanges 80 go up the side of the tie, to allow a lag bolts 84 (as illustrated in FIG. 11) to be inserted into holes 82 fasten the shield plate 74, through the tie plate into the tie to secure the unit. The shield plate 74 will be fastened on the top and side and will push up against the armature of the yoke to prevent the shield plate 74 from caving inward. There is a flange on the inside also from top to bottom that rests against the armature to provide room for the driver to come in and take the fastener out of the side of the tie easily.

An example of the assembly and operation of the washout detector 10(1) on the railroad tie T will now be described with reference to FIGS. 1-4. Although the operation is described with respect to a railroad tie T, the washout detector could provide the same operation attached to other structures, such as a bridge or a building. The washout detector 10(1) is attached to the railroad tie T by attaching bolts through the holes 30 in the flanges 28 of the housing 12 to the railroad tie T. The locking mechanism between the pad 20 and the spring loaded ram 16 is released when the washout detector 10(1) is installed on the tie T allowing the spring-loaded ram 16 to provide a downward force on the pad 20 into the ballast of the roadbed. The washout detector 10(1) operates by sensing the erosion of the roadbed ballast dropping away from the pad 20.

As the pad 20 is depressed due to erosion of the ballast, the indicator blade 50 is raised from the indicator housing 48 to provide a visual indication of the roadbed condition. In this example, the indicator blade 50 provides a visual indication in various stages as the pad 20 is depressed through the different colors on the indicator blade 50. Some ballast settlement or bedding-in of the pad 20 may occur after installation, so roughly the first third of the detection distance (beyond an initial zero-response threshold) is an incipient phase of roadbed depression detection, which is indicated by a green portion of the indicator blade 50. The second stage of roadbed depression, roughly the middle third of the pad 20 depression extent, is a cautionary level of detection and warning indicated by a yellow portion on the indicator blade. The last and largest phase of detection extent will be represented by the last third of detection range, and beyond that as washout of the ballast progresses. This is the terminal or red alert warning stage which is indicated by a red portion of the indicator blade 50. Once the pad 20 is depressed to a certain level, an end of travel indicator 54, as described above is released from the indicator housing 48 to indicate a washout condition.

Optionally, the downward motion of the pad 20 as a result of ballast erosion further may cause the optional hydraulic ram 18 to push down from the housing 12. As the hydraulic ram 18 is lowered, hydraulic fluid is pulled into the hydraulic ram portion of the housing 12 from the hydraulic fluid reservoir 19 through the one or more poppet valves 62. The hydraulic ram 18 and the captive fluid drawn from the hydraulic fluid reservoir 19 supports the railroad tie T in order to maintain the position of the tie until the ballast erosion condition is rectified.

Further, the sensor 26 may monitor the position of the pad 20. The sensing may be accomplished manually, with a rod-and-foot linear drop sensor, or an angled-paddle rotary-horizontal-shaft sensor. Alternatively, the sensing may also be accomplished through non-contact means, by ultrasonic distance detection, electromagnetic or electro-optical distance or auto-focus sensing methods, or by other remote-sensing methods as appropriate. The alarm computing device may remotely provide alerts to one or more computing devices over a communication network to provide indications of the condition of the roadbed.

Accordingly, as illustrated and described with reference to the examples herein this technology provides more washout detector apparatuses and methods thereof. Additionally, this technology provides a cost-effective railroad roadbed washout detector confined within a housing that is adapted to withstand the stresses required for performance on a railroad tie. With this technology, both remote and local alarms may be provided to indicate railroad roadbed conditions. Further, with this technology the local alarm computing device provide an indication of the railroad roadbed condition in various stages to provide unique information regarding the roadbed to trains passing the location.

Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited order of processing elements or sequences, or the use of numbers, letters, or other designations therefore, is not intended to limit the claimed processes to any order except as may be specified in the claims. Accordingly, the invention is limited only by the following claims and equivalents thereto.

What is claimed is:

1. A washout detector apparatus comprising:

a detector member movably disposed in at least a portion of a detector housing, the detector housing is configured to be secured to a structure;

a biasing device disposed in the detector housing and positioned to bias the detector member in a direction out from the portion of the detector housing towards a surface perpendicular to the structure;

a pad coupled to an outer end of the detector member outside of the portion of the detector housing to contact the surface when installed; and an indicator coupled to the detector member to provide a condition of the surface based on movement of the detector member with respect to the surface.

2. The apparatus as set forth in claim 1, wherein the detector housing is configured to be coupled to one or more of an end or a side of a railroad tie.

3. The apparatus as set forth in claim 1, wherein the detector housing is configured to be positioned in a recessed portion of a railroad tie.

4. The apparatus as set forth in claim 1, wherein the pad is pivotally coupled to the outer end of the detector member.

5. The apparatus as set forth in claim 1, wherein the indicator comprises an indicator blade movably disposed in an another portion of the detector housing and coupled to the detector member to move in response to movement of the detector member, the indicator blade having two or more status designations disposed along a length of the indicator blade.

6. The apparatus as set forth in claim 5, wherein the indicator blade comprises at least three different colored status designations indicating an incipient, a progressive, and a terminal condition of the surface.

7. The apparatus as set forth in claim 6, wherein the indicator blade further comprises an end of travel indicator.

8. The apparatus as set forth in claim 1 further comprising a hydraulic ram located in the portion of the detector housing and coupled to the detector member, wherein the hydraulic ram maintains a positioning of the structure in response to the downward movement of the detector member.

9. The apparatus as set forth in claim 1, wherein the indicator further comprises:

a sensor configured to detect movement of the detector member; and a remote alarm computing device coupled to the sensor, wherein the remote alarm computing device is configured to provide remote alerts based on the detected movement of the detector member by the sensor.

10. A method of making a washout detector comprising:

providing a detector member movably disposed in at least a portion of a detector housing, the detector housing configured to be secured to a structure;

providing a biasing device disposed in the detector housing and positioned to bias the detector member in a direction out from the portion of the detector housing towards a surface perpendicular to the structure; and coupling a pad to an outer end of the detector member outside of the portion of the detector housing to contact the surface when installed; and coupling an indicator to the detector member to provide a condition of the surface based on movement of the detector member with respect to the surface.

11. The method as set forth in claim 10, wherein the detector housing is configured to be coupled to one or more of an end or a side of a railroad tie.

12. The method as set forth in claim 10, wherein the detector housing is configured to be positioned in a recessed portion of a railroad tie.

13. The method as set forth in claim 10, wherein the pad is pivotally coupled to the outer end of the detector member.

14. The method as set forth in claim 10, wherein the indicator comprises an indicator blade movably disposed in an another portion of the detector housing and coupled to the detector member move in response to movement of the detector member, the indicator blade having two or more status designations disposed along a length of the indicator blade.

15. The method as set forth in claim 14, wherein the indicator blade comprises at least three different colored status designations indicating an incipient, a progressive, and a terminal condition of the surface.

16. The method as set forth in claim 15, wherein the indicator blade further comprises an end of travel indicator.

17. The method as set forth in claim 10 further comprising:

providing a hydraulic ram located in the portion of the detector housing and coupled to the detector member, wherein the hydraulic ram maintains a positioning of the structure in response to the downward movement of the detector member.

18. The method as set forth in claim 10 further comprising:

providing a sensor configured to detect any movement of the detector member; and coupling a remote alarm computing device to the sensor, wherein the remote alarm computing device is configured to provide remote alerts based on the detected movement of the detector member by the sensor.

19. A washout detector apparatus comprising:

a detector member movably disposed in at least a portion of a detector housing, the detector housing is configured to be secured to a structure;

a biasing device disposed in the detector housing and positioned to bias the detector member in a direction out from the portion of the detector housing towards a surface perpendicular to the structure;

a hydraulic ram located in the portion of the detector housing and coupled to the detector member, wherein the hydraulic ram maintains a positioning of the structure in response to the downward movement of the detector member; and an indicator coupled to the detector member to provide a condition of the surface based on movement of the detector member with respect to the surface.

20. The apparatus as set forth in claim 19, wherein the indicator further comprises:

a sensor configured to detect movement of the detector member; and a remote alarm computing device coupled to the sensor, wherein the remote alarm computing device is configured to provide remote alerts based on the detected movement of the detector member by the sensor.

* * * * *